US006482133B1

(12) United States Patent
Miehlich

(10) Patent No.: US 6,482,133 B1
(45) Date of Patent: Nov. 19, 2002

(54) TRAINING DEVICE

(76) Inventor: Dieter Miehlich, Fuggerstrasse 26, D-86494 Emersacker (DE)

( * ) Notice: Subject to any disclaimer, the term of this patent is extended or adjusted under 35 U.S.C. 154(b) by 10 days.

(21) Appl. No.: 09/621,256

(22) Filed: Jul. 21, 2000

(30) Foreign Application Priority Data

Aug. 12, 1999 (DE) ..... 199 38 094

(51) Int. Cl.[7] ..... A63B 69/06
(52) U.S. Cl. ..... 482/72; 482/71; 482/57
(58) Field of Search ..... 482/95, 96, 52, 482/51, 72, 64, 65, 71, 57

(56) References Cited

U.S. PATENT DOCUMENTS

| | | | | |
|---|---|---|---|---|
| 2,455,548 A | * | 12/1948 | Bell | 482/95 |
| 3,446,503 A | * | 5/1969 | Lawton | 482/95 |
| 5,507,709 A | * | 4/1996 | Wu | 482/72 |
| 5,533,953 A | * | 7/1996 | Lui et al. | 482/96 |
| 5,582,563 A | * | 12/1996 | Fan | 482/96 |

* cited by examiner

*Primary Examiner*—Jerome W. Donnelly
(74) *Attorney, Agent, or Firm*—Nields & Lemack

(57) ABSTRACT

The seat (10) of a training device is connected via parallelogram arms (**6*a*, 6*b*) to a base frame (2) so that it can execute circular-segment movements in reference to the base frame. A training force transmission frame (26) is articulated to a parallelogram arm, and one end is mounted to a crank mechanism (22) that acts on a belt pulley (24) which is connected via a belt (24) to a flywheel (38). A brake (40) (against which the trainee works) acts on the flywheel. A grip holder (30) with handgrips (32) extends upward from the transmission frame (26) before the seat. Footrests (18) are also provided on the base frame (2). The relative movements between the seat (10), the transmission frame (26) that executes a combined lengthwise and swinging motion, and the base frame (2) allow force to be exerted from the seat via the hand grips to the transmission frame to exercise the arms and upper body. Moving the transmission frame (26) by moving the legs with the help of the footrests allows the legs and stomach muscles to be trained. A backrest (12**) with a spinal column support holds the trainee in an orthopedically favorable position.

12 Claims, 3 Drawing Sheets

TRAINING DEVICE

Figure 1:
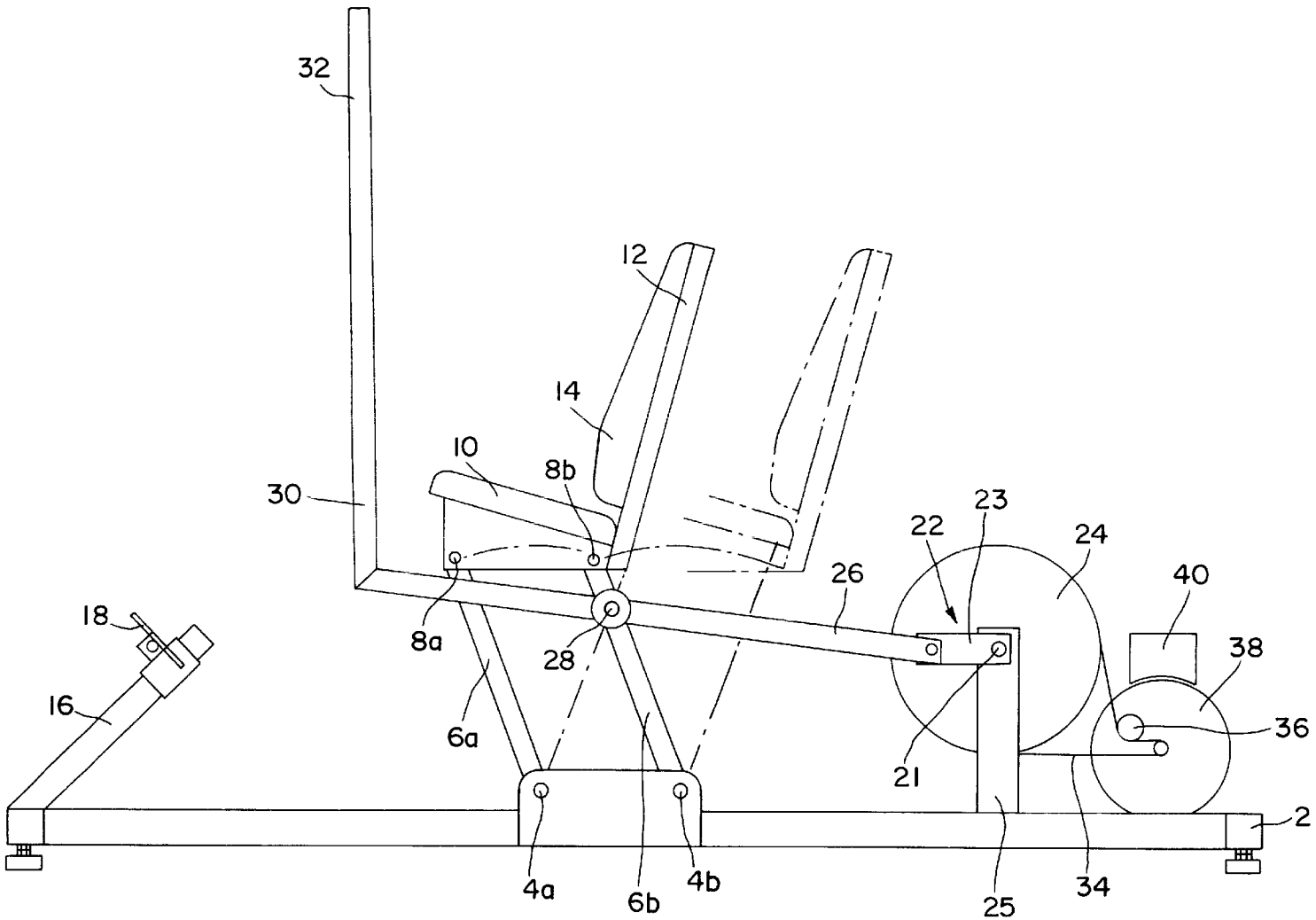

The invention concerns a training device with the features cited in the preamble of claim 1.

There are numerous prior art strength and endurance training devices that are used as home trainers or in fitness studios for training different muscle groups or enhancing the cardiovascular system. For example, U.S. Pat. No. 5,342,269 describes an arm-training device according to the preamble of claim 1 in which a two-arm lever is mounted to a support of a base frame. There are handles on the top lever arm, while the bottom lever arm is articulated via a connecting rod to a parallelogram brace of a parallelogram guide of the seat. If you pull the handles toward you, the seat is pulled to the front, and it is lifted while overcoming the body weight of the trainee. In another training device in U.S. Pat. No. 5,507,709, the seat is also mounted via a parallelogram guide to a carrier functioning as a support frame, and a bearing arm of this parallelogram is connected via a lever mechanism to supports that pivot on a bearing point in the base frame. There are two handles pivoted to an associated lengthwise brace so that a combined movement of the seat, hand grips and foot rests is obtained, and the load is provided by the body weight of the trainee. Finally, U.S. Pat. No. 5,733,227 has an arm and leg training device that works with a crank mechanism on a brake wheel with adjustable braking force. The trainee stands on two footrests that he moves up and down to train his legs while simultaneously moving the handgrips back and forth.

Training using these devices is usually quite arduous and therefore not for everyone. Frequently, training programs are interrupted.

The invention is based on the problem of designing a generic training device so that people can simultaneously train their arm, leg and stomach muscles while moving in a harmonized and pleasant manner.

The problem of the invention is solved by the features in claim 1. Developments of the invention are described in the subclaims.

The parallelogram guide of the seat and the articulation of the force transmitting frame to the seat parallelogram and the crank mechanism produces a series of movements in which the arm, leg, stomach and back muscles are simultaneously trained without the trainee feeling that the program is burdensome which could cause him to abandon training prematurely. The results of training are therefore better than with conventional endurance and cardiovascular equipment since the trainee enjoys the training motions and is not actually conscious of the effort of the training program due to the harmonized sequence of movements.

In a useful embodiment of the invention, the crank mechanism can be designed with an adjustable stroke and hence allow the extent of training movements to be adapted to the individual and hence the progress of the user. The stroke can be adjusted e.g. by varying the articulation points of the transmission frame (that transfer the force exerted by the trainee to a flywheel that overcomes the deadpoint of the movement sequence) to the crank arms. The arms are seated e.g. on a shaft connected to a belt pulley whose belt drives the flywheel. Usefully interacting with the flywheel is a preferably adjustable brake in the form of an eddy current brake, friction brake, hydraulic brake, etc. that allows the training force to be adjusted. Furthermore, the footrests can be adjusted to adapt to the body size of the trainee. If footrests are provided with loops, the training effect can be expanded by a pulling movement in addition to pressing with the feet. A preferred embodiment of the transmission frame consists of two lengthwise levers whose ends are articulated to the crank arms of the crank mechanism and which are mounted via a middle bearing to the seat parallelogram. These levers can usefully be angled outward on both sides of the seat and terminate upward so that their ends form the handles.

To avoid improper stress on the vertebral column, the seat is preferably provided with a backrest against which the trainee leans and which provides an orthopedically correct support for the spinal column during training.

Articulating the transmission frame to a preferably adjustable intermediate position of one of the parallelogram arms (by means of which the seat is articulated to the base frame) creates a relative movement between the seat and handgrips that allows the training device to be moved just by arm force. The training device according to the invention can hence be used to exercise the arm muscles or leg muscles by themselves or together including stomach muscles.

Figure 2:
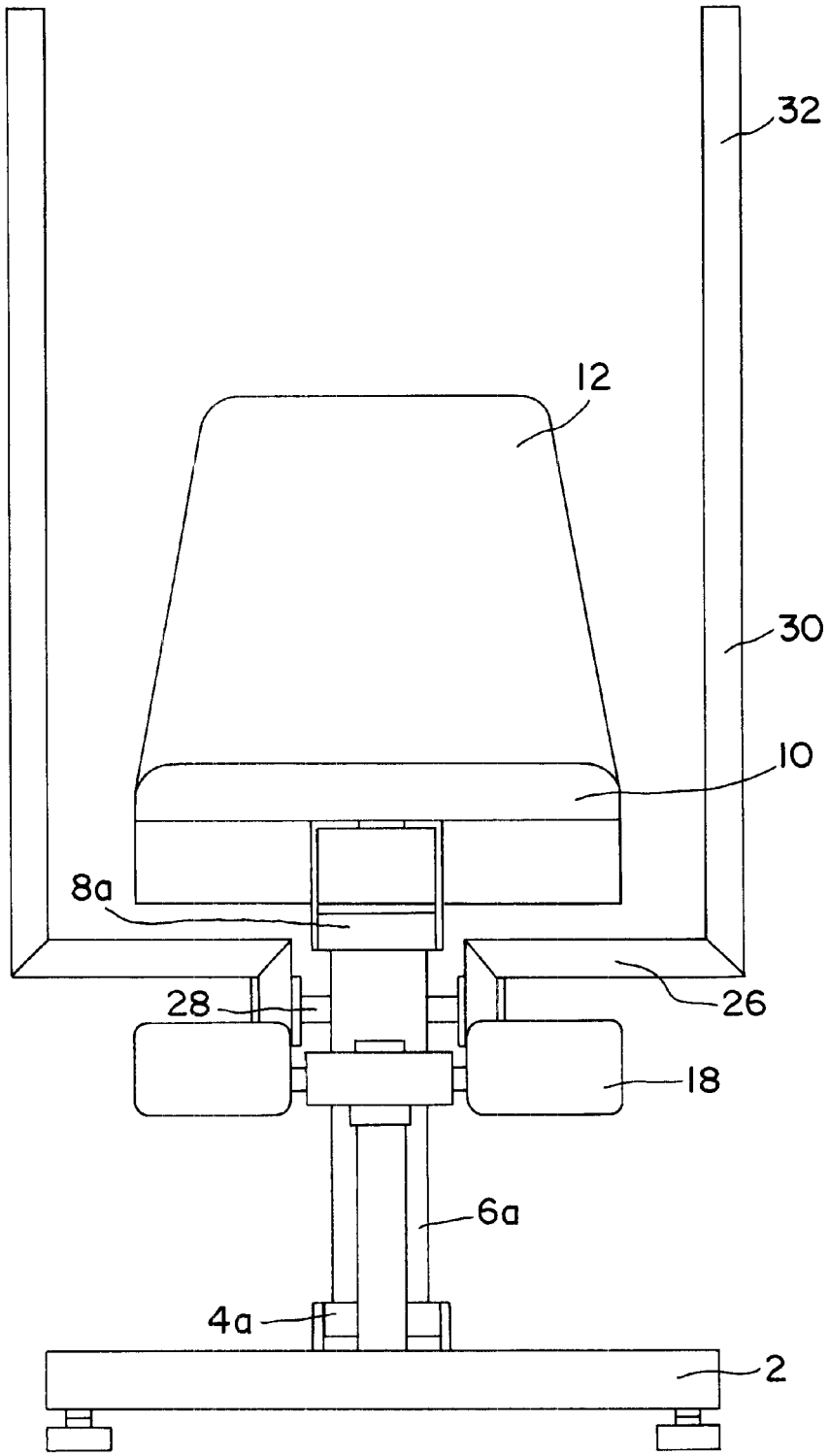

The invention will now be further explained with reference to an exemplary embodiment illustrated in the attached drawings. Shown are:

FIG. 1 A schematic side view to illustrate the design of an exemplary embodiment of the training device according to the invention;

FIG. 2 A schematic front view, and

Figure 3:
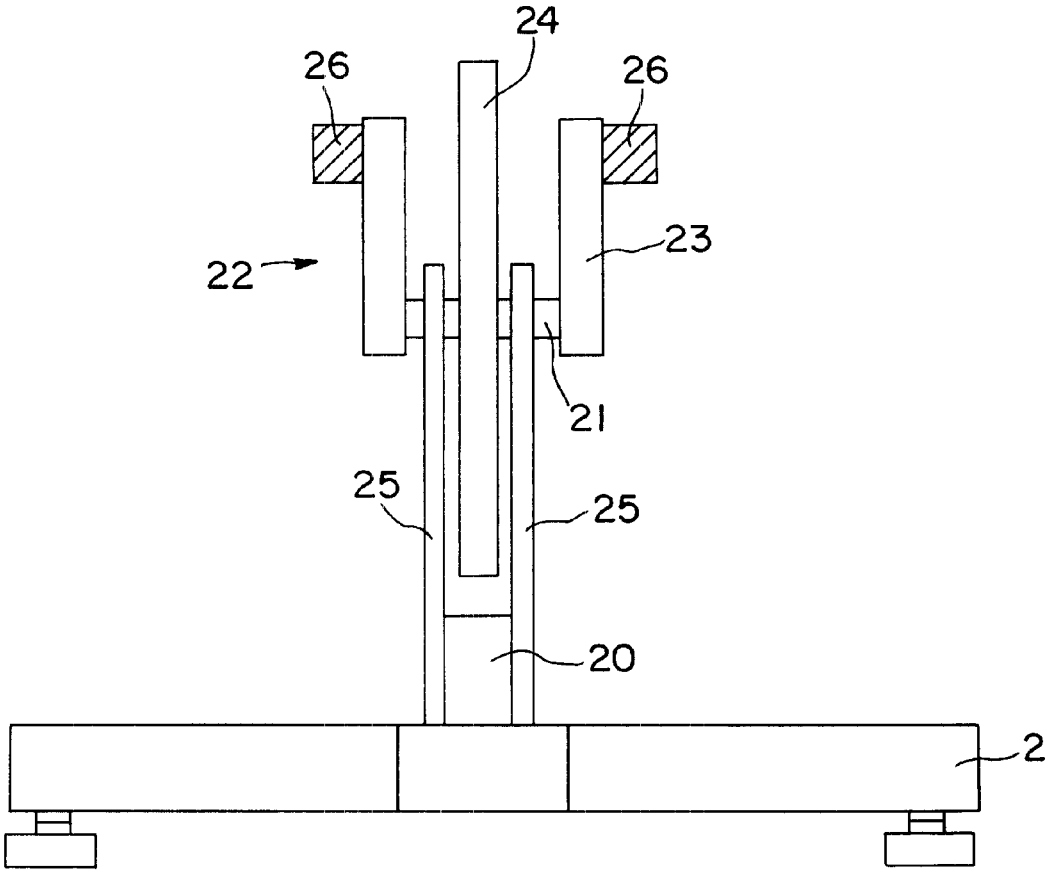

FIG. 3 A schematic detailed view of the crank mechanism.

The side view in FIG. 1 shows a base frame 2 with bottom articulation points 4*a* and 4*b* for two parallelogram arms 6*a* and 6*b* whose other ends form top articulation points 8*a* and 8*b* for a seat 10. The seat is equipped with a backrest 12 that has a spinal column support 14 which provides the correct seated posture when training. Thus the backrest 12 supports the lumbar region. The front end of the base frame 2 is also provided with footrests 18, adjustably mounted to a holder 16, each of which can be equipped with a holding loop for a foot (not shown).

On the other end of the base frame 2 is a bearing 20 for a crank mechanism 22 that, on its crank arms 23, has bearing points for a transmission frame 26 that is formed by two lengthwise levers which are connected to the parallelogram arms 6*b* via articulation points 28 that can be adjusted if desired. The front ends of the levers terminate in grip holders 30 with handgrips 32. Due to the placement of the articulation points 28 of these levers of the transmission frame 26 between the top and bottom articulation points 8*b*, 4*b* of the parallelogram arm 6*b*, a relative movement between the seat 10 and transmission frame 26 can be executed so that the hand grips 32 can be pulled or pushed by the trainee's arms to move the transmission frame 26 in relation to the base frame 2 and create a movement cycle just by using arms and not feet. By moving the legs, the seat 10 can be moved with the trainee back and forth in relation to the base frame 2 as can be directly seen in FIG. 1.

While the seat 10 moves along a circular segment, the transmission frame 26 executes a combined lengthwise and swinging movement that is determined by the parallelogram arm 6*b* and the circular movement of the crank mechanism 22. These movements of the transmission frame 26 cause a belt pulley 24 to rotate via the crank mechanism 22. The rotation of the belt pulley 24 is transferred by a drive (that can usefully be designed as a belt 34 or e.g. a chain that is pretensioned by a belt tightener 36 in the portrayed example) to a flywheel 38 that is influenced by a brake 40 with preferably settable braking force so that the movement resistance can be adjusted for the trainee to work against it.

As shown in FIG. 2, two grip holders 30 extending upward from the transmission frame 26 to form grips 32 that the trainee alternately pulls toward and presses away from his body. In addition, there are two footrests 18 against which the trainee braces himself to move back the seat and transmission frame 26. A pair of foot loops (not shown) allows the opposite force to be exerted, that is, draw the seat and transmission frame toward the footrests so that the bending and stretching muscles can be trained as with arm training.

FIG. 3 shows the bearing 20 at the rear of the base frame 2 in the form of a bearing block for the crank mechanism 22. Mounted in the bearing block is a shaft 21, and crank arms 23 are seated on both ends. The transmission frame 26 is articulated to these crank arms whose stroke movement is determined by the effective crank length. This can be adjusted (not shown) by e.g. moving the articulation points in the crank arms to different radii, or the length can be continually adjusted in a radial slot. The belt pulley 24 sits between the two prongs 25 of the bearing block on a shaft 21 and transmits the rotary movement of the crank arms 23 via the belt 34 to the flywheel 38 whose rotation is quicker than that of the belt pulley corresponding to the radial ratio of the belt pulley and flywheel axis. The transmission frame 26 is forked at its rear and is articulated to the crank arms 23 with the fork ends formed in this manner.

Training can be varied and effective, and arms and legs can optionally be exercised together or by themselves which helps the trainee's endurance.

What is claimed is:

1. A training device with a base frame with footrests and hand grips by means of which a force resistance mechanism is actuated, and with a seat that is mounted to a parallelogram guide, and a transmission part connected to the handgrips is articulated to one bearing arm of the parallel guide to link the movements of the seat and hand grips, characterized in that:

a) The transmission part is a transmission frame (26), b) The transmission frame (26) is linked to a crank mechanism (22), c) The crank mechanism (22) can be actuated against a braking force.

2. A training device according to claim 1, characterized in that the stroke of the crank mechanism (22) can be adjusted.

3. A training device according to claim 2, characterized in that the crank mechanism (22) is designed as an eccentric wheel.

4. A training device according to claim 1, wherein said bearing arm (6) has bearing points (4*b*, 8*b*), and wherein the transmission frame (26) is connected at one end thereof to the crank mechanism (22) and at an intermediate point thereof to a potentially adjustable articulation point (28) located between the bearing points (4*b*, 8*b*) of the bearing arm (6).

5. A training device according to claim 4, characterized in that the handgrips (32) are mounted on a grip holder (30) connected to the transmission frame (26).

6. A training device according to claim 5, characterized in that the transmission frame (26) is formed by two mirror-opposite, lengthwise levers that are bent outward to the side in the area of the seat and terminate upward in grip holders (30) and handgrips (32).

7. A training device according to one of claims 1, 2 or 3, characterized in that the crank mechanism (22) acts on a belt pulley (24).

8. A training device according to claim 7, characterized in that the belt pulley (24) drives a flywheel (38).

9. A training device according to claim 8, characterized in that a brake (40) is linked to the flywheel (38).

10. A training device according to claim 8, characterized in that an adjustable brake (40) is linked to the flywheel (38).

11. A training device according to claim 1, characterized in that the seat (10) is provided with a backrest (12) that supports the lumbar region.

12. A training device according to claim 1, characterized in that the footrests (18) are adjustable and have retention loops.

* * * * *